United States Patent [19]

Koike et al.

[11] Patent Number: 4,715,353

[45] Date of Patent: Dec. 29, 1987

[54] ULTRASONIC WAVE TYPE FUEL ATOMIZING APPARATUS FOR INTERNAL COMBUSTION ENGINE

[75] Inventors: Hiroshi Koike, Katsuta; Hiroshi Katada, Mito; Hiroshi Yoneda, Katsuta, all of Japan

[73] Assignees: Hitachi, Ltd., Tokyo; Hitachi Automotive Engineering Co., Ltd., Katsuta, both of Japan

[21] Appl. No.: 943,748

[22] Filed: Dec. 19, 1986

[30] Foreign Application Priority Data

Dec. 25, 1985 [JP] Japan ..... 60-290652

[51] Int. Cl.[4] ..... F02M 29/00

[52] U.S. Cl. ..... 123/590; 123/490; 361/152

[58] Field of Search ..... 123/590, 490; 361/152, 361/154

[56] References Cited

U.S. PATENT DOCUMENTS 4,473,861 9/1984 Kosak et al. ..... 123/490
4,576,136 3/1986 Yamauchi et al. ..... 123/590
4,590,915 5/1986 Yamauchi et al. ..... 123/590
4,628,885 12/1986 Ogburn et al. ..... 123/490
4,665,877 5/1987 Manaka et al. ..... 123/590

*Primary Examiner*—E. Rollins Cross
*Attorney, Agent, or Firm*—Antonelli, Terry & Wands

[57] ABSTRACT

An ultrasonic wave type fuel atomizing apparatus for an internal combustion engine provided in an intake passage of the internal combustion engine and atomizing the fuel injected from a fuel injection pump by the ultrasonic wave vibration includes an ultrasonic wave vibrator, an oscillation circuit for generating ultrasonic waves for driving the ultrasonic wave vibrator, and a high voltage generating coil for boosting the output of the oscillation circuit and for applying the driving output to the ultrasonic wave vibrator, and furthermore, a feedback circuit is included to detect a current flowing through the high voltage generating coil and to control an oscillation frequency of the oscillation circuit thereby to make the driving frequency follow the resonance point of the ultrasonic wave vibrator.

6 Claims, 9 Drawing Figures

ULTRASONIC WAVE TYPE FUEL ATOMIZING APPARATUS FOR INTERNAL COMBUSTION ENGINE

BACKGROUND OF THE INVENTION

The present invention relates to a fuel supplying apparatus for supplying atomized fuel to an internal combustion engine, and in particular, to a fuel atomizing apparatus utilizing an ultrasonic wave vibrator.

An apparatus for supplying atomized fuel to an internal combustion engine utilizing an ultrasonic wave vibrator is known from, for example Japanese Patent Laid-Open (Kokai) Publication No. 58-210354 (1983). In such an apparatus, in a driving method of driving the ultrasonic wave vibrator, in order to cope with a deviation of the resonance point caused when the ultrasonic wave vibrator is driven at a fixed frequency, the period of an applied voltage to the ultrasonic wave vibrator is changed at a predetermined interval of period.

In the prior art, however, since the driving frequency of the ultrasonic wave vibrator is changed alternately to increase and to decrease at a predetermined period interval and with a predetermined width, there is a drawback in that a period of time in which the driving frequency coincides with the resonance point is only a fraction of the whole driving time, and thus the efficiency of the overall apparatus is degraded.

SUMMARY OF THE INVENTION

The present invention was made in view of the drawbacks in the prior art, and it is an object of the present invention to provide an ultrasonic wave type fuel atomizing apparatus for an internal combustion engine, which is capable of controlling automatically the driving frequency so as to always produce a maximum output irrespective of a variation of the resonance point of the ultrasonic wave vibrator, and which exhibits a high efficiency.

The aforementioned object is achieved in an ultrasonic wave fuel atomizing apparatus which applies a driving frequency voltage to an ultrasonic wave vibrator, by detecting a consumed current value supplied to the ultrasonic wave vibrator for driving, and by performing a feedback control of the driving frequency in a direction the consumed current value increases.

Even if the resonance point of the ultrasonic wave vibrator is deviated due to an increase in weight by adherence of fuel, when the ultrasonic wave vibrator is vibrating near the resonance point, a consumed value of a driving current, that is, an output current of a driving circuit increases rapidly, and a consumed current of the driving circuit also increases rapidly.

In the present invention, by feedback controlling the driving frequency by utilizing the aforementioned phenomenon, the driving frequency can be made to always follow the resonance point, and thus, it is possible to obtain a maximum efficiency of the overall apparatus.

DESCRIPTION OF THE PREFERRED EMBODIMENTS

Hereinafter, the embodiments of the present invention will be described in detail with reference to the drawings.

Figure 1A:
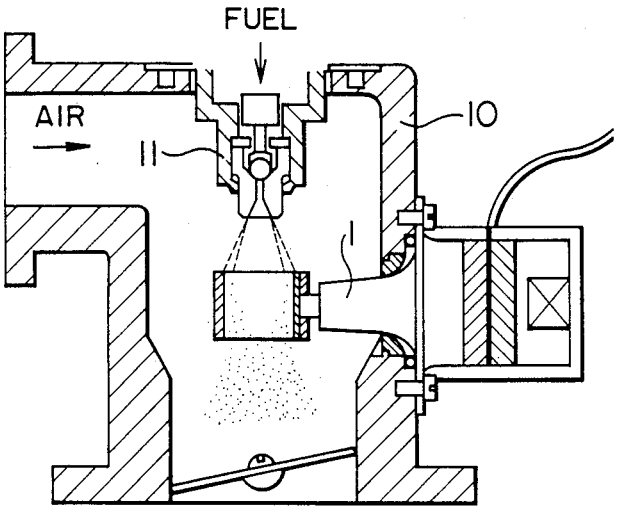
FIGS. 1A and 1B are respectively a sectional view and a circuit diagram showing an example of an ultrasonic wave type fuel atomizing apparatus for an internal combustion engine according to the present invention.
Figure 1B:
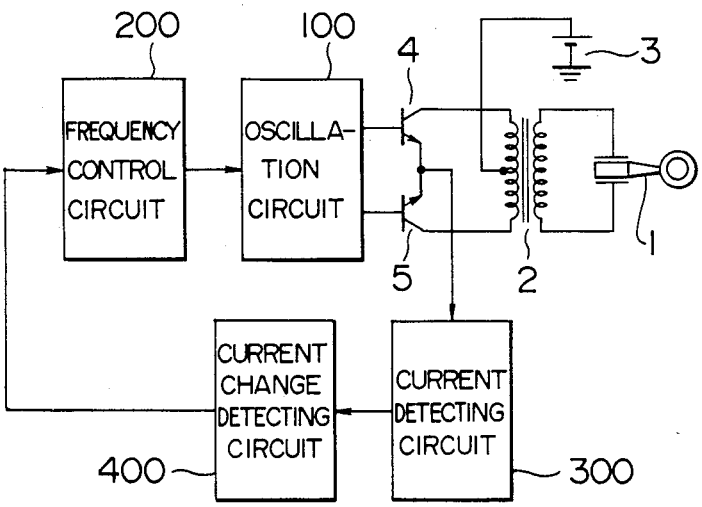

In FIGS. 1A and 1B, the reference numeral 1 designates an ultrasonic wave vibrator provided in an intake passage 10 of an internal combustion engine for atomizing fuel injected from a fuel injection valve 11, and the ultrasonic wave vibrator 1 vibrates at ultrasonic wave frequencies by an AC voltage applied to a piezoelectric element to atomize the fuel of the internal combustion engine. Reference numeral 2 designates a high voltage generating coil including a primary winding having a center tap, a secondary winding, and an iron core, and when a primary winding current supplied from a power supply 3 is interrupted alternately by power transistors 4 and 5, a high AC voltage is generated in the secondary winding depending on a turn ratio, and the generated high AC voltage is applied to the ultrasonic wave vibrator 1.

Reference numeral 100 designates an oscillation circuit oscillating at ultrasonic wave frequencies (about 28 KHz–40 KHz), and it supplies base currents to the power transistors 4 and 5 to control the alternate conduction thereof. Reference numeral 200 designates a frequency control circuit for controlling the oscillation frequency of the oscillation circuit 100 in accordance with an output of a current change detecting circuit 400 to increase or decrease the oscillation frequency.

Reference numeral 300 designates a current detecting circuit for detecting a current of the high voltage generating coil 2 by the currents flowing through the emitters of the power transistors 4 and 5. The current change detecting circuit 400 monitors a change in the output of the current detecting circuit 300, and the former supplies an output to the frequency control circuit 200 to increase the frequency as long as the output of the current detecting circuit 300 is increasing, and when the output of the current detecting circuit 300 decreases, the current change detecting circuit 400 supplies an output to decrease the frequency.

Figure 2:
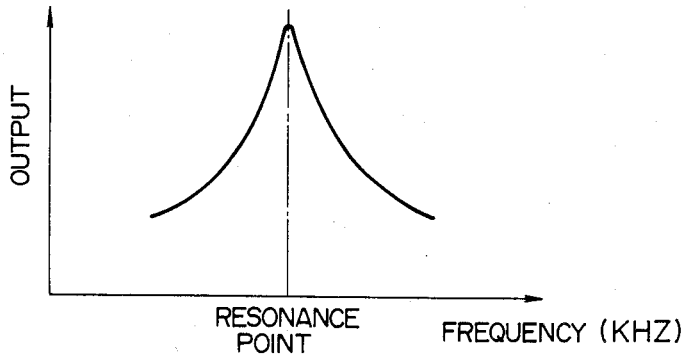
FIG. 2 is an output characteristic diagram of the vibrator in FIG. 1.

On the other hand, the output of the ultrasonic wave vibrator 1 becomes maximum when the driving frequency coincides with the resonance point of the vibrator 1 as shown in FIG. 2, and the output decreases at frequencies at both sides of the resonance point. Further, since the change in the output is coincident relatively to a change in the input of the high voltage generating coil 2, the currents flowing through the power transistors 4 and 5 also become maximum at the resonance point of the vibrator 1.

The operation of the apparatus arranged as shown in FIGS. 1A and 1B will be described. Firstly, during a time in which the oscillation frequency is lower than the resonance point, the current of the high voltage generating coil 2 tends to increase with the increase of the frequency, and hence, the current change detecting circuit 400 supplies the output to the frequency control circuit 200 so as to increase the oscillation frequency of the oscillation circuit 1. Thus, the oscillation frequency increases gradually, and when the frequency exceeds the resonance point, since the current of the high voltage generating coil 2 is decreased, contrary to the above case, the current change detecting circuit 400 supplies the output to decrease the oscillation frequency, and the frequency is decreased. As a result, the oscillation frequency is controlled such that the frequency is made to increase when the frequency is decreased with respect to the resonance point, and the frequency is made to decrease when the frequency is increased with respect to the resonance point. In this manner, the oscillation frequency is stabilized automatically at and near the resonance frequency. Moreover, even when the resonance frequency of the vibrator is changed, the oscillation frequency automatically follows the resonance frequency, and the oscillation frequency is stabilized at frequencies at and near the resonance frequency.

Hereinafter, each block of the circuit in FIG. 1B will be described in detail.

Figure 3:
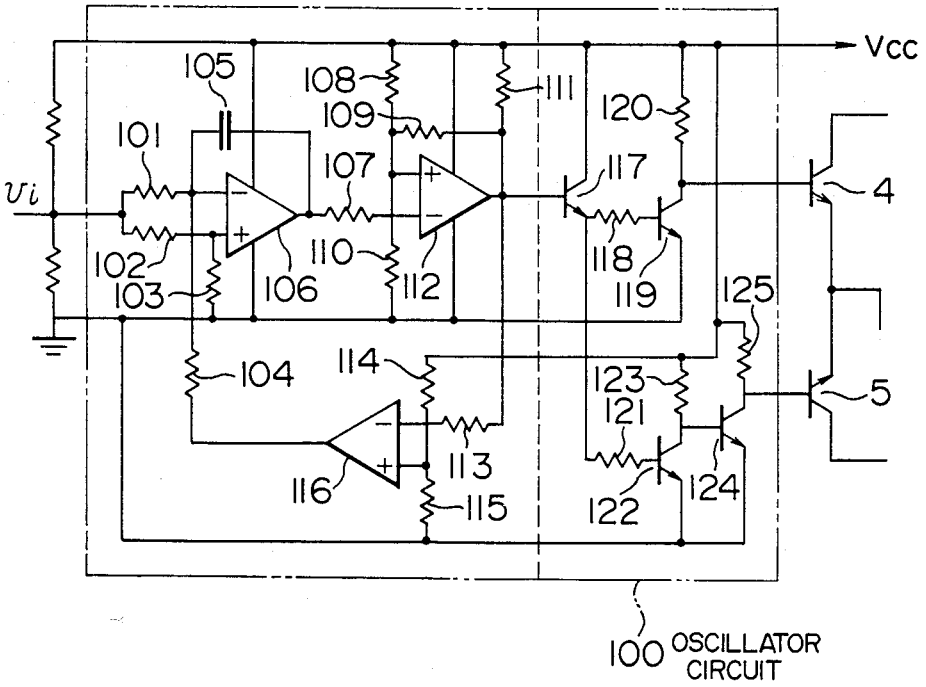
FIG. 3 is a circuit diagram of an embodiment of the oscillation circuit in FIG. 1.

As the oscillation circuit 100, for example, a voltage controlled oscillation circuit can be used, and a concrete example in such a case is shown in FIG. 3. In FIG. 3, reference numerals 101, 102, 103, and 104 designate resistors, 105 a capacitor, 106 an operational amplifier, 107, 108, 109, 110, and 111 resistors, 112 a comparator, 113, 114, and 115 resistors, and 116 a comparator. These members constitute a voltage controlled oscillator. Since the voltage controlled oscillator is well known, a detailed description is omitted, however, in this case, a square wave whose oscillation frequency is changed in accordance with a voltage Vi at the junction point between the resistors 101 and 102 is delivered from the output of the comparator 112. Reference numeral 117 designates a transistor constituting an emitter follower circuit, and it prevents the oscillation frequency from being changed due to a change in the output voltage of the comparator 112, depending on the values of the resistors 118 and 121 connected to the emitter of the transistor 117. Reference numeral 119 designates a transistor, and 120 designates a resistor, and the transistor 119 amplifies the oscillation frequency and drives the power transistor 4. Reference numerals 122 and 124 designate transistors, and 123 and 25 designate resistors, and the transistors 122 and 124 drive the power transistor 5 with the oscillation output whose phase is inverted with respect to the phase of the oscillation output applied to the power transistor 4.

Accordingly, the oscillation circuit 100 oscillates at a frequency determined by the input voltage Vi supplied from the frequency control circuit 200 and outputs two square waves having phases inverted from each other thereby to drive the power transistors 4 and 5. As the frequency control circuit 200, for example, a circuit as shown in FIG. 4 can be used.

Figure 4:
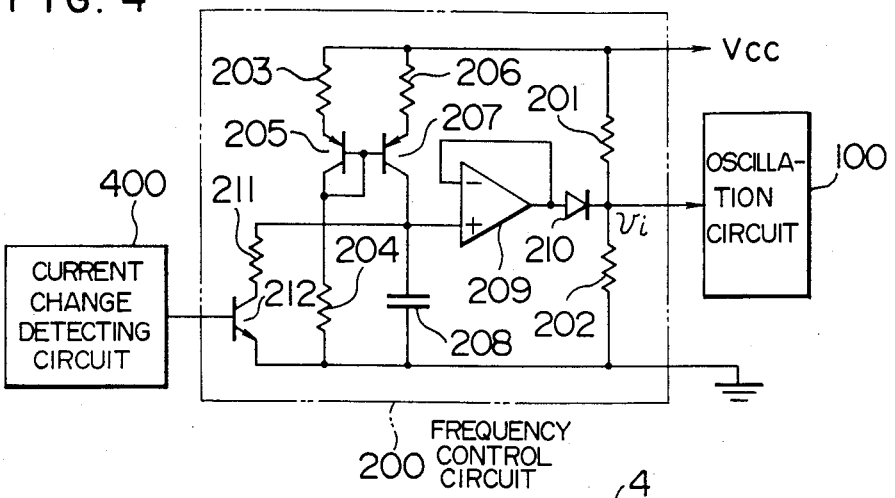
FIG. 4 is a circuit diagram of an embodiment of the frequency control circuit in FIG. 1.

In FIG. 4, reference numerals 201 and 202 designate resistors for dividing a voltage $V_{cc}$ and determining a minimum value of the voltage Vi which determines the frequency of the oscillation circuit 100. Reference numerals 203 and 204 designate resistors, 205 a transistor, 206 a resistor, and 207 a transistor. These members constitute a constant-current circuit to change a capacitor 208 and to increase the voltage of the capacitor 208 at a constant gradient. Reference numeral 209 designates an operational amplifier in which the output is fed back to a negative terminal, and the impedance is transformed so that the voltage of the capacitor 208 is not changed to increase depending on a value of the voltage Vi. Reference numeral 210 designates a diode which allows a current to flow only in the direction from the capacitor 208 towards the voltage Vi, and prevents the flow in the opposite direction. Reference numeral 211 designates a resistor, and 212 a transistor, and the transistor 212 functions to lower the charged voltage of the capacitor 208 by allowing the discharge in accordance with the output of the current change detection circuit 400.

In this circuit, during a time in which the charged voltage of the capacitor 208 is lower than a sum of the divided voltage of the resistors 201, 202 and the voltage drop in the diode 210, the voltage Vi for determining the oscillation frequency is determined by the divided voltage of the voltage $V_{cc}$ by the resistors 201 and 202. When the voltage of the capacitor 208 charged by a constant current becomes higher than the sum of the aforementioned divided voltage and the diode drop voltage, the voltage Vi is determined by the voltage of the capacitor 208. Further, when the output is fed back, and when the transistor 212 is turned on (ON condition) by a signal from the current change detecting circuit 400, the voltage of the capacitor 208 is decreased by an amount determined by a width of the signal, a resistance of the resistor 211, and a capacity of the capacitor 208.

In this manner, the frequency determining voltage Vi, at first, starts from a value determined by the dividing ratio of the resistors 251 and 202, and then, when the capacitor 208 is charged and when the charged voltage becomes equal to or larger than the sum of the divided voltage and the diode drop voltage, the value of the voltage Vi is determined by the voltage of the capacitor 208 and is increased gradually. And the voltage Vi is decreased while the output of the current change detecting circuit 400 exists, and when the output disappears, the voltage Vi is increased again.

Figure 5:
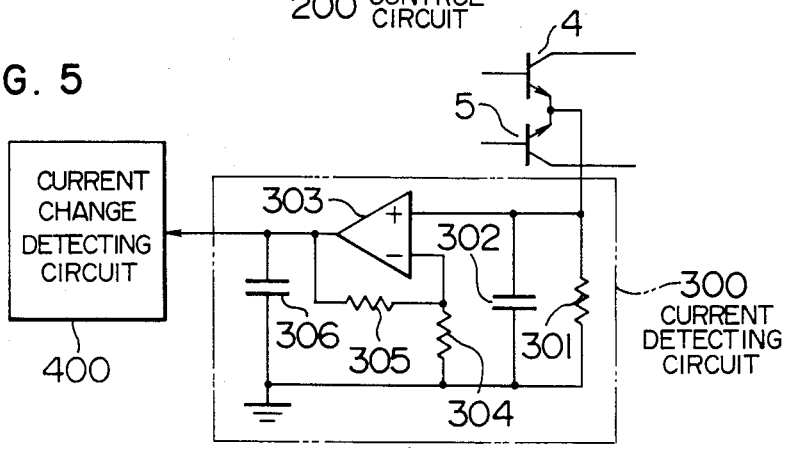
FIG. 5 is a circuit diagram of an embodiment of the current detecting circuit in FIG. 1.

Next, an embodiment of the current detecting circuit 300 will be described with reference to FIG. 5. In FIG. 5, reference numeral 301 designates a resistor for detecting a current from the power transistors 4 and 5. Reference numeral 302 designates a capacitor for smoothing a voltage drop due to the resistor 301. Reference numeral 303 designates an operational amplifier, and 304, 305 designate resistors, and these members constitute a noninverting amplifier. Reference numeral 306 designates a capacitor for smoothing an output of the amplifier 303.

By the circuit mentioned above, the current from the power transistors 4 and 5 is detected and amplified to (1+R305/R304) times as large as the input value, and supplied to the current change detecting circuit 400 after smoothing thereof.

Next, an embodiment of the current change detecting circuit 400 will be described with reference to FIG. 6.

Reference numeral 401 designates a capacitor, 402 a resistor, and 403 a diode, and these members constitute a differentiating circuit. Reference numeral 404 designates a comparator, and 405 and 406 designate resistors for determining a reference voltage by dividing the voltage $V_{cc}$. Reference numeral 407 designates a resistor, and 408 designates a capacitor, which determine a time in which the output of the comparator 404 is in a HIGH state. Reference numeral 409 designates a resistor, 410 and 411 designate transistors, and 412 designates a resistor, and the transistor 411 is normally in an OFF state, and is caused to be in an ON state only when a negative signal is inputted from the capacitor 401. Reference numerals 413 and 414 designate resistors which transfers the output of the comparator 404 to the frequency control circuit 200.

In the circuit described above, during a time in which the output of the current detecting circuit 300 is constant or increasing, the transistor 410 is in the ON state and the transistor 411 is in the OFF state, and since the input of the comparator 404 is at a HIGH level at the negative input terminal with respect to the positive input terminal, the output goes to a LOW level.

Then, when the output of the current detecting circuit 300 is decreased, a pulse current flows through the capacitor 401, resistor 402, and diode 403 to bring the transistor 410 in an OFF state, and thus, the electric charge on the capacitor 408 is discharged through the transistor 411, and the output of the comparator 404 goes to a HIGH level.

And this HIGH output state of the comparator 404 is continued until the level of the negative input terminal becomes the same level as the positive input terminal due to the charging of the capacitor 408 through the resistor 407, and then the output of the comparator 404 goes to the LOW state. In other words, as long as the output from the current detecting circuit 300 is constant or increasing, the current change detecting circuit 400 does not deliver an output, and when the output from the current detecting circuit 300 is decreased, the output is delivered from the current change detecting circuit 400 only for a fixed time period from the instant of decrease.

Figure 7:
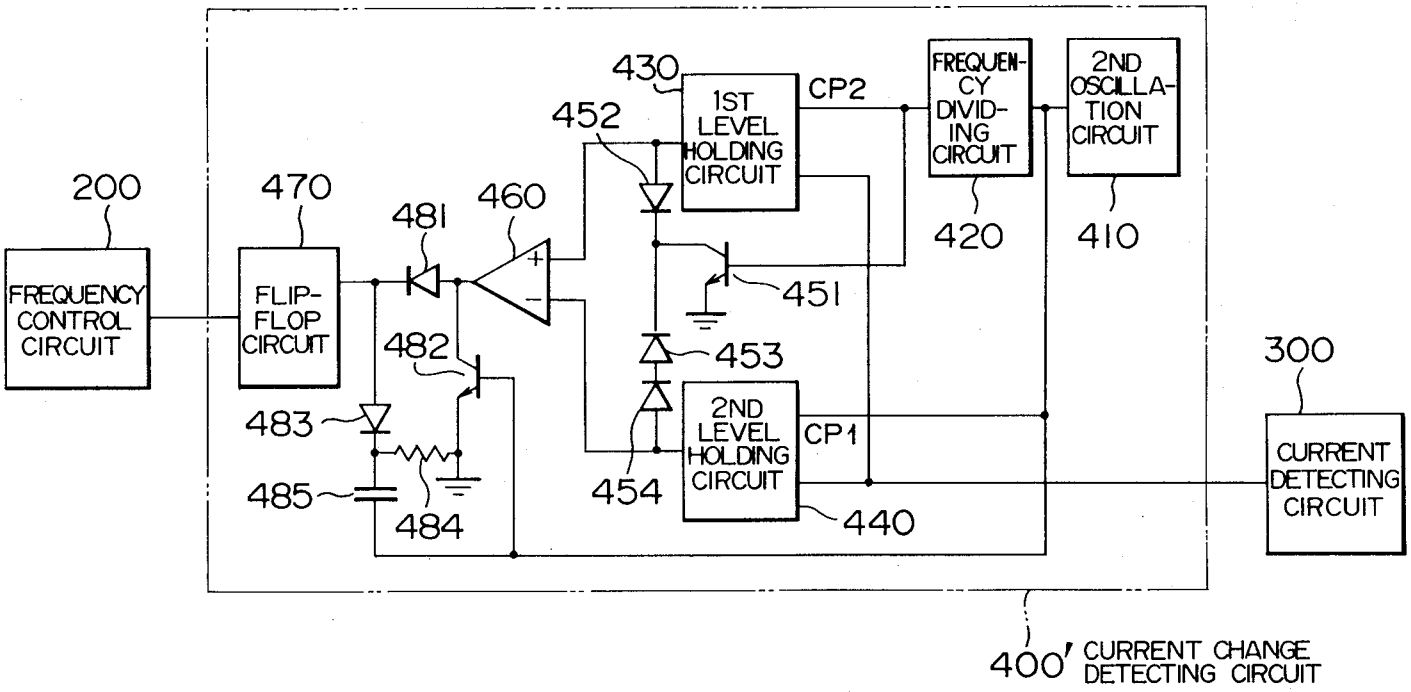
FIG. 7 is a circuit diagram of another embodiment of the current change detecting circuit in FIG. 1.

Further, another embodiment of the current change detecting circuit is shown in FIG. 7.

In FIG. 7, reference numeral 410 designates a second oscillation circuit, and 420 designates a frequency dividing circuit for dividing an oscillation frequency of the oscillation circuit 410 to a half (½).

Reference numerals 430 and 440 designate first and second level holding circuits, 451 a transistor, and 452, 453 and 454 designate diodes, and the first and second level holding circuits 430 and 440 respectively hold the levels of the output of the current detecting circuit 300, at two successive time points, that is, one level is detected during a low period of the output of the frequency dividing circuit 420, at a time of decay of the output of the oscillation circuit 410, and the other level is detected at a time of decay of the output of the frequency dividing circuit 420. And the output signals of the first and second level holding circuits 430 and 440 respectively indicative of the two levels of the output of the current detecting circuit 300 are used as input signals of a comparator 460. Further, in the comparator 460, the voltage level of the positive input terminal is lowered by one diode 452 connected thereto, and the voltage level of the negative input terminal is lowered by two diodes 453, 454 connected thereto. As a result, a level difference is produced between the positive and negative input terminals so that the output of the comparator 460 is stabilized normally in the LOW state. Reference numeral 481 designates a diode and 482 designates a transistor, and during a time period in which the output of the oscillation circuit 410 is at a high level, the output of the comparator 460 is short circuited and it is not transfered to the next stage. Reference numeral 470 designates a flip-flop, 483 a diode, 484 a resistor, and 485 a capacitor, and when a signal is supplied through the diode 481, the output of the flip-flop 470 goes to a HIGH state, and then this output goes to a LOW state at the decay of the output of the oscillating circuit 410.

Figure 8:
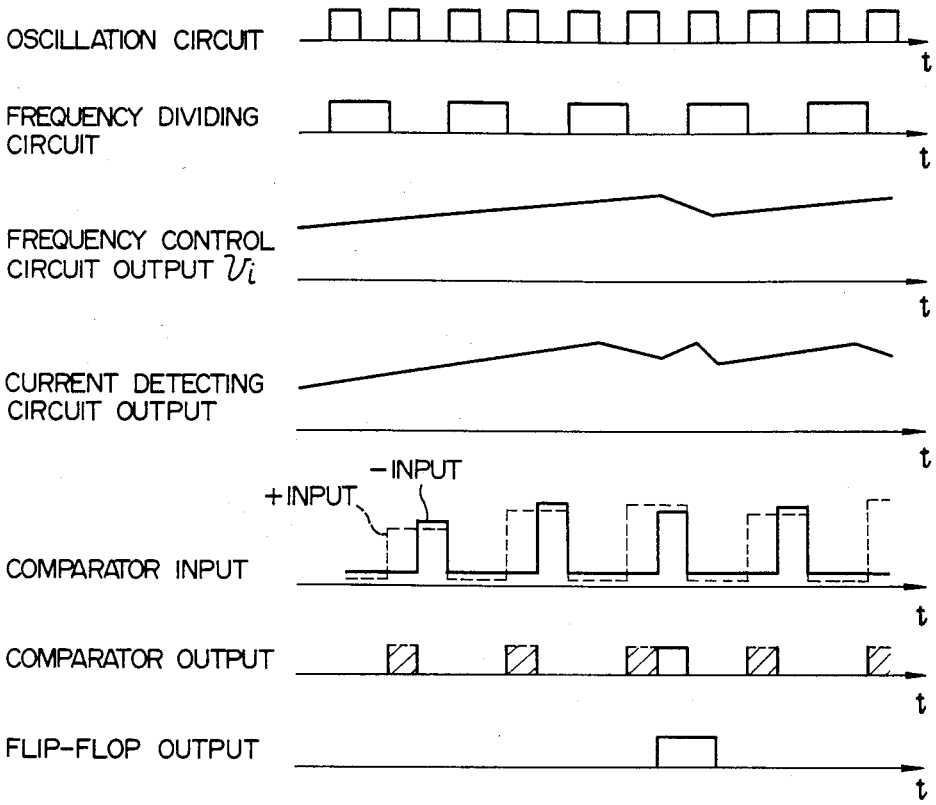
FIG. 8 shows waveforms for explaining the operation of the circuit of FIG. 7.

The operation of the circuit mentioned above will be described with reference to waveforms of various parts shown in FIG. 8.

First, as long as the frequency of the oscillation circuit 100 is lower than the resonance point of the vibrator 1, the output voltage Vi of the frequency control circuit 200 is increased gradually, and the output of the current detecting circuit 300 is also increased.

The first level holding circuit 430 detects the level of the output of the current detecting circuit 300 at the time of decay of the output of the frequency dividing circuit 420, and supplies a signal indicative of the level to the positive input terminal of the comparator 460, and the second level holding circuit 440 detects the level of the output of the current detecting circuit 300 at the time of decay of the output of the oscillation circuit 410, and supplies a signal indicative of the level to the negative input terminal of the comparator 460. And, since the output of the current detecting circuit 300 is increasing, the level detected at a later time, that is, the signal supplied to the negative input terminal of the comparator 460 is higher than the other, and thus, the output of the comparator 460 assumes a LOW state.

Further, in this case, during a time period from the detection of the level by the first level holding circuit 430 to the dection of the level by the second level holding circuit 440, the positive input terminal of the comparator 460 is at a higher level than the negative input terminal, and thus, the output of the comparator 460 assumes a HIGH state. However, this output of the comparator 460 is short circuited through the transistor 482 by the signal from the oscillating circuit 410, and the output of the comparator 460 is not transferred to the next stage. When the output of the comparator 460 is in a LOW state, the output of the flip-flop 470 also remains in a LOW state, and thus, the output of the frequency control circuit 200 and the frequency of the oscillation circuit 410 continue to increase.

Next, when the oscillation frequency exceeds the resonance point, the output of the current detecting circuit 300 begins to decrease with time. And since the output of the second level holding circuit 440 which detects the level of the output of the current detecting circuit 300 at the time of decay of the output of the oscillation circuit 410 becomes a higher level than the output of the first level holding circuit 430 which detects the level of the output of the current detecting circuit 300 at the time of decay of the output of the frequency dividing circuit 420, the output of the comparator 460 goes to a HIGH state, and the output of the flip-flop 470 is inverted to assume a HIGH state. As a result, the output voltage Vi of the frequency control circuit 200 and also the oscillation frequency are decreased. And this decrease is continued until the flip-flop 470 is reset by the decay of the output of the oscillation circuit 410. When the output of the flip-flop 470 is reset to a LOW state, the oscillation frequency is increased again.

As described in the foregoing, in the circuit mentioned above, the level of the output of the current detecting circuit 300 is detected at two different times, and the detected two levels are compared with each other. And as long as the level detected at the later is higher than the other, the oscillation frequency is made to increase, and when the level detected at the earlier time becomes higher than the other, the oscillation frequency is made to decrease, and in this manner, the oscillation frequency is stabilized at or near the resonance point.

Figure 6:
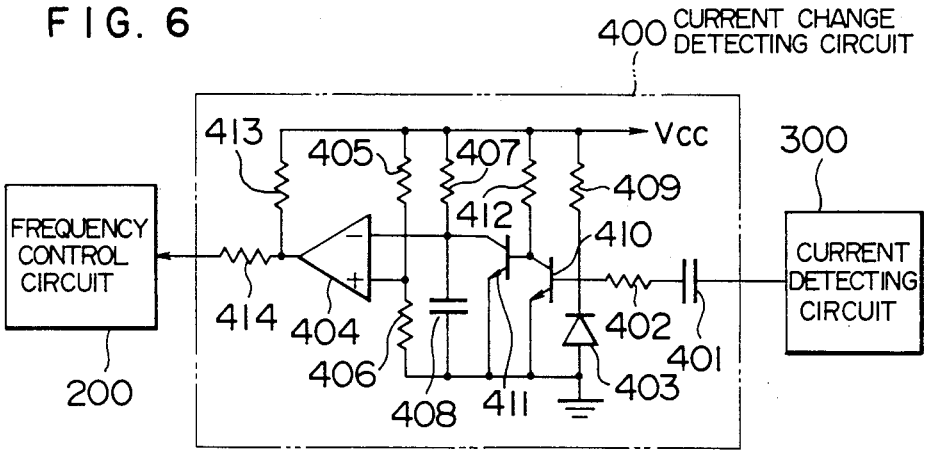
FIG. 6 is a circuit diagram of an embodiment of the current change detecting circuit in FIG. 1.

When the circuit of FIG. 6 is compared with the circuit of FIG. 7, the circuit of FIG. 6 is advantageous in the scale of the circuit. On the other hand, when the rate of change of the output with respect to the frequency is small, the differentiating circuit is sometimes unable to pick out the output change, and is such a case the circuit of FIG. 7 is advantageous in that the operation is easily stabilized.

Further, when a microcomputer is used to compare the levels and to control the frequency, the circuit of FIG. 7 can be replaced as it is.

In the present invention, there is an advantage in that since the oscillation frequency can be controlled to make the current flowing through a high voltage generating coil maximum, the oscillation frequency can be automatically controlled so that the oscillation frequency is generated at or near the resonance point of the vibrator independently of the temperature of the oscillation circuit, the temperature of the vibrator, the load, etc., and owing to this, an ultrasonic wave type fuel atomizing apparatus for an internal combustion engine with high efficiency can be obtained.

We claim:

1. An ultrasonic wave type fuel atomizing apparatus for an internal combustion engine for supplying atomized fuel to said internal combustion engine, comprising:

an ultrasonic wave vibrator provided in an intake passage of said internal combustion engine for atomizing fuel supplied thereto by vibrating at ultrasonic wave frequencies;

an oscillation circuit for producing ultrasonic waves used to drive said ultrasonic wave vibrator;

means for supplying an oscillation output of said oscillation circuit to said ultrasonic wave vibrator by increasing the oscillation output; and a feedback circuit for controlling an oscillation frequency of said oscillation circuit in accordance with an output of said ultrasonic vibrator.

2. An apparatus according to claim 1, wherein said means for supplying an oscillation output includes a high voltage generating coil for boosting the oscillation output of ultrasonic waves from said oscillation circuit and for applying a boosted output to said ultrasonic wave vibrator, and said feedback circuit detects a current of said high voltage generating coil and uses as the output of said ultrasonic wave vibrator.

3. An apparatus according to claim 1, wherein said feedback circuit includes a frequency control circuit, a current detecting circuit, and a current change detecting circuit.

4. An apparatus according to claim 3, wherein said frequency control circuit is adapted to change over an oscillation frequency of said oscillation circuit to increase or decrease continuously in accordance with an output of said current change detecting circuit.

5. An apparatus according to claim 3, wherein said current change detecting circuit includes a differentiating circuit connected to said current detecting circuit, and a one-shot multivibrator circuit for delivering an output for a fixed time after receiving an output from said differentiating circuit.

6. An apparatus according to claim 3, wherein said current change detecting circuit includes two level holding circuits for taking in and holding the output of said current detecting circuit at a fixed period and at different times with an interval therebetween, a comparator circuit for comparing outputs of said two level holding circuits and for delivering an output only when the output of one of said two level holding circuits taking in the output of said current detecting circuit at a later time is lower than the other output of the other of said two level holding circuits, and a flip-flop circuit for delivering an output upon being set by the output of said comparator, said flip-flop circuit being reset after a fixed time.

* * * * *